US007823842B2

(12) United States Patent
Stalzer

(10) Patent No.: US 7,823,842 B2
(45) **Date of Patent: *Nov. 2, 2010**

(54) APPARATUS FOR DETECTING MOVEMENT DIRECTION OF MODEL TRAIN

(76) Inventor: Leo H. Stalzer, 9864 Ione La., St. Louis, MO (US) 63123

( * ) Notice: Subject to any disclaimer, the term of this patent is extended or adjusted under 35 U.S.C. 154(b) by 513 days.

This patent is subject to a terminal disclaimer.

(21) Appl. No.: 11/843,222

(22) Filed: Aug. 22, 2007

(65) Prior Publication Data

US 2008/0042014 A1 Feb. 21, 2008

Related U.S. Application Data

(63) Continuation-in-part of application No. 11/420,270, filed on May 25, 2006, now Pat. No. 7,566,032.

(51) Int. Cl.
*B61L 25/02* (2006.01)

(52) U.S. Cl. ..... 246/122 A

(58) Field of Classification Search ..... 246/122 R, 246/122 A, 123, 124, 249

See application file for complete search history.

(56) References Cited

U.S. PATENT DOCUMENTS

| | | | | |
|---|---|---|---|---|
| 2,039,828 | A | | 5/1936 | Nicholson |
| 3,259,741 | A | | 7/1966 | Fosse et al. |
| 3,672,611 | A | | 6/1972 | Thorne-Booth |
| 4,034,168 | A | * | 7/1977 | Brown ..... 191/2 |
| 4,185,561 | A | * | 1/1980 | Reymann ..... 104/302 |
| 4,223,857 | A | | 9/1980 | Hussein |
| 4,611,291 | A | | 9/1986 | Hoelscher |
| 5,417,388 | A | | 5/1995 | Stillwell |
| 5,451,017 | A | * | 9/1995 | Graff et al. ..... 246/220 |
| 5,492,290 | A | | 2/1996 | Quinn et al. |
| 5,590,855 | A | | 1/1997 | Kato et al. |
| 5,590,856 | A | | 1/1997 | Quinn et al. |
| 5,678,789 | A | | 10/1997 | Pipich |
| 6,308,920 | B1 | | 10/2001 | Zander |
| 6,663,053 | B1 | | 12/2003 | Shams |
| 7,566,032 | B2 | * | 7/2009 | Stalzer ..... 246/122 A |

* cited by examiner

*Primary Examiner*—S. Joseph Morano
*Assistant Examiner*—Robert J McCarry, Jr.
(74) *Attorney, Agent, or Firm*—Polster, Lieder, Woodruff & Lucchesi, L.C.

(57) ABSTRACT

An apparatus for determining the direction of travel of an electrically driven model train through a model railroad track layout having track segments with rails of opposite polarity is disclosed. A diode and transistor are operatively coupled to at least one rail of a powered track segment, such that passage of an electrically driven model train over the powered track segment in a first direction enables a flow of electrical current through the transistor to a signal or control circuit, while passage of the electrically driven model train over the powered track segment in a second direction does not. The polarity of the rails is determined by a circuit driven by a control circuit attached to an adjacent track segment.

3 Claims, 7 Drawing Sheets

APPARATUS FOR DETECTING MOVEMENT DIRECTION OF MODEL TRAIN

CROSS-REFERENCE TO RELATED APPLICATIONS

The present application is a continuation-in-part of co-pending U.S. patent application Ser. No. 11/420,270 filed on May 25, 2006, from which priority is claimed and which is herein incorporated by reference.

STATEMENT REGARDING FEDERALLY SPONSORED RESEARCH

Not Applicable.

BACKGROUND OF THE INVENTION

The present application is related to the control systems for model railroad systems, and in particular, to a method and apparatus for detecting the presence and direction of any movement of an electrically driven model train along a track system to activate relays, accessories, or directional indicator signals.

Model railroad systems are becoming increasingly popular among hobby and train enthusiasts. Typically, in a model railroad system, sections of track are laid out and interconnected with various junctions and switches to provide one or more track pathways for an electrically driven model train to travel along. The electrically driven model train generally receives a supply of electrical power through the conductive portions of the track sections over which it travels. The direction of movement of the model train is regulated by the electrical polarity of the two rails in each track section, and correspondingly, the direction of an electrical current flow from the conductive rails through the electrical motor in the model train. For a first polarity, the model train will be driven in a first direction. By switching the polarity of an electrical potential supplied to the two rails with a reversing switch or relay, such as a double pole double throw switch, the direction of travel of the model train is correspondingly reversed.

To sustain movement of a model train around a track layout, sequential segments of track must be supplied with driving electrical power of matching polarity, and down-track junctions must be electrically switched to continue the motion or route the train in the correct direction. Furthermore, it is necessary to provide a means to identify the current track segment on which the model train is presently occupied and the direction of any movement of the train. On basic model train layouts, much of this is done by visual observation of the model train position and direction of motion, allowing an operator to ensure that sequential segments of track onto which the model train will move are provided with the correct polarity. However, on large scale model train layouts, the position and direction of movement of the model train may not be visible to an operator at all times, and multiple model trains may be moving about the tracks simultaneously.

Accordingly, there is a need to provide an apparatus which is capable of providing an operator with a signal indicating the presence of a train on a track segment, and the direction of travel of the train across that track segment. It would further be advantageous to provide an apparatus which is capable of utilizing the detected presence and direction of travel of a model train to selectively activate one or more down-track junctions or track segments to maintain automatic movement of the model train in the desired direction.

BRIEF SUMMARY OF THE INVENTION

Briefly stated, the present invention provides a device configured for determining the direction of travel of an electrically driven model train through a model railroad track layout. In a preferred embodiment, the device consists of a diode and transistor which are operatively coupled to one rail of a powered track segment, such that passage of an electrically driven model train over the powered track segment in a first direction enables a flow of electrical current through the transistor to a signal or control circuit, while passage of the electrically driven model train over the powered track segment in a second direction does not.

In an alternate embodiment of the model train detection system present invention, the system consists of a set of diodes and transistors operatively coupled to each rail of a powered track segment, such that passage of an electrically driven model train over the powered track segment in a first direction enables a flow of electrical current through a first transistor to a signal or control circuit, while passage of the electrically driven model train over the powered track segment in a second direction enables a flow of electrical current through the second transistor to a second signal or control circuit.

In an alternate embodiment of the present invention, the model train detection system is configured with an electrical circuit to detect the presence and direction of travel of an electrically driven model train over a monitored track segment, and to responsively send an electrical signal to the next down-track segment of track to selectively enable the electrical polarity of that track segment for continued travel of the model train in the same direction.

The foregoing features and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings. It is to be understood that the drawings are for illustrating the concepts of the invention and are not to scale.

DESCRIPTION OF THE PREFERRED EMBODIMENT

The following detailed description illustrates the invention by way of example and not by way of limitation. The description enables one skilled in the art to make and use the invention, and describes several embodiments, adaptations, variations, alternatives, and uses of the invention, including what is presently believed to be the best mode of carrying out the invention.

Figure 1:
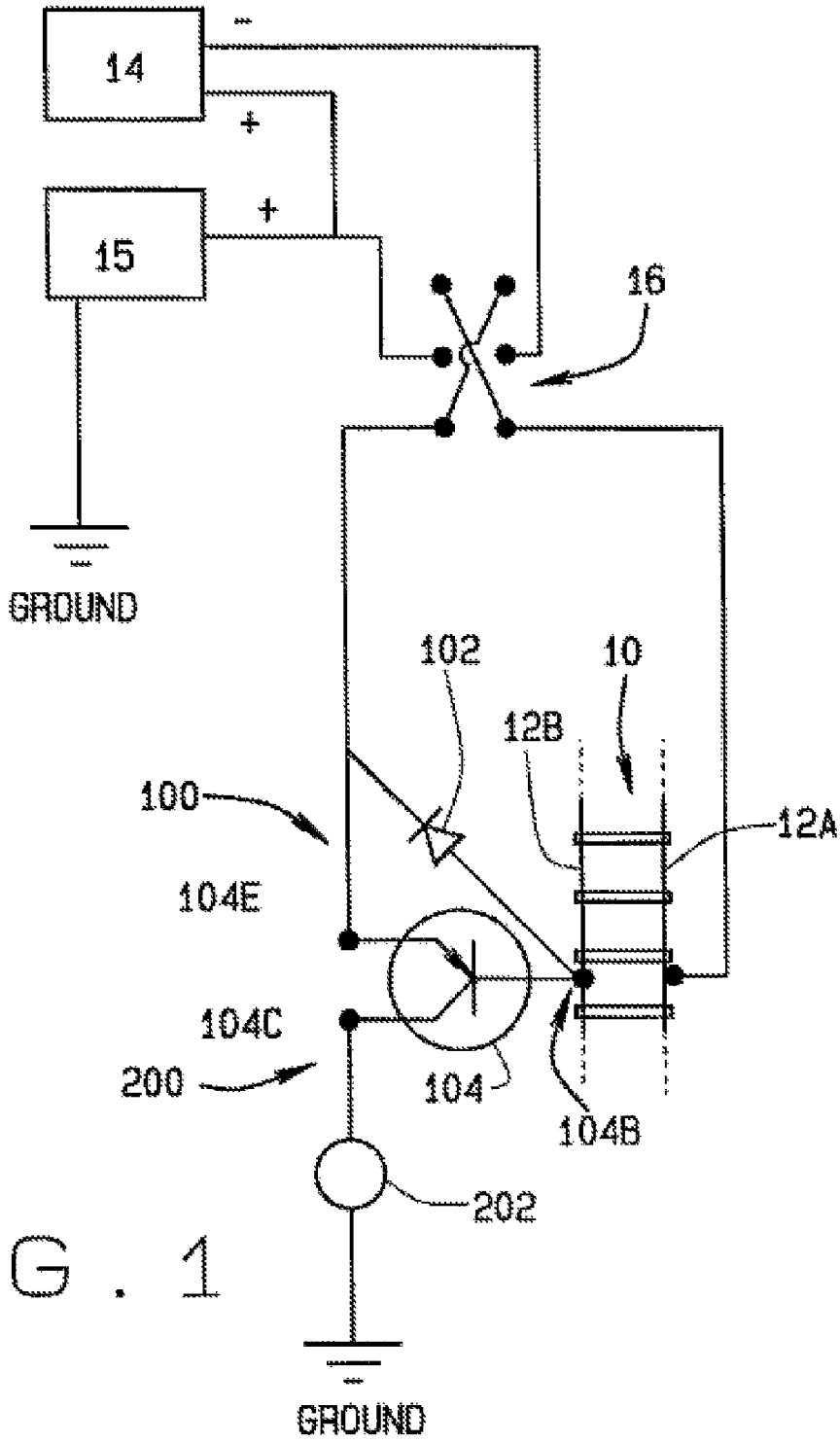
FIG. 1 is a schematic representation of a model train detection circuit of the present invention for detecting movement in a single direction along a track segment.

Turning to FIG. 1, a model train track segment 10, having first and second conductive rails 12A and 12B is shown coupled to a source of electrical power 14 for driving a model train (not shown) over the track segment 10 and a source of sensor electrical power 15. The sources of electrical power 14 and 15 are operatively coupled to each of the conductive rails 12A and 12B through a reversing switch or relay 16, such as a double-pole, double throw switch. When a model train (not shown) is positioned on the track segment 10, an electrical circuit is completed between conductive rails 12A and 12B by the driving motor (not shown) of the model train (not shown). The selected polarity of the conductive rails 12A and 12B determines the direction of movement of the model train (not shown) over the track segment 10 by establishing the direction of rotation of the driving motor (not shown). Switching the polarity, such as with the reversing switch or relay 16, reverses the direction of movement of the model train (not shown) over the track segment 10.

A train detector 100, consisting of a diode 102 and a transistor 104 is operatively coupled between the conductive rail 12B and the source of electrical power 14. The diode 102 is coupled between the conductive rail 12B and the source of electrical power 14 to provide a first electrical pathway. A second electrical pathway between the conductive rail 12B and the source of electrical power 14 is provided by the transistor 104. Specifically, as shown in FIG. 1, a base 104B of the transistor 104 is operatively coupled to the conductive rail 12B, while an emitter 104E of the transistor is operatively coupled to the source of electrical power 14. A collector 104C of the transistor is operatively coupled to an external electrical circuit 200, such as an indicator, relay, or other device.

When a model train (not shown) is disposed on the track segment 10, and the conductive rails 12A and 12B are configured with a first polarity configuration, a first electrical pathway is completed from the source of electrical power 14 to rail 12A, through the driving engine (not shown) of the model train (not shown), into rail 12B, and back to the source of electrical power through the diode 102, driving the model train (not shown) in a first direction. The flow of electrical current is blocked from the external electrical circuit 200 by the transistor 104.

When the reversing switch or relay 16 is actuated, the polarity configuration of the conductive rails 12A and 12B is reversed. The diode 102 blocks a flow of electrical current along the first electrical pathway, and instead, electrical current flows from source of electrical power 14, to the emitter 104E of the transistor 104. From the emitter 104E, the electrical current flows to the base 104B, through the conducive rail 12B, driving engine (not shown) of the model train (not shown), conductive rail 12A, and back to the source of electrical power 14. The model train (not shown) is then driven by the flow of electrical current in a second and opposite direction along the segment of track 10. Within the transistor 104, an additional flow of electrical current is directed from the emitter 104E to the collector 104C, and provided to the external electrical circuit 200.

In the embodiment of the present invention shown in FIG. 1, the train detector 100 is configured to energize the external electrical circuit 200 only when the model train (not shown) is moving over the track segment 10 in one direction. If the external electrical circuit 200 includes an indicator such as a light emitting diode 202, this indicator will selectively indicate the presence of a model train on the track segment 10 only when the track polarity (and hence train movement) is selected via the switch 16 such that the electrical current flow between the rails 12A and 12B passes through the transistor 104.

Figure 2:
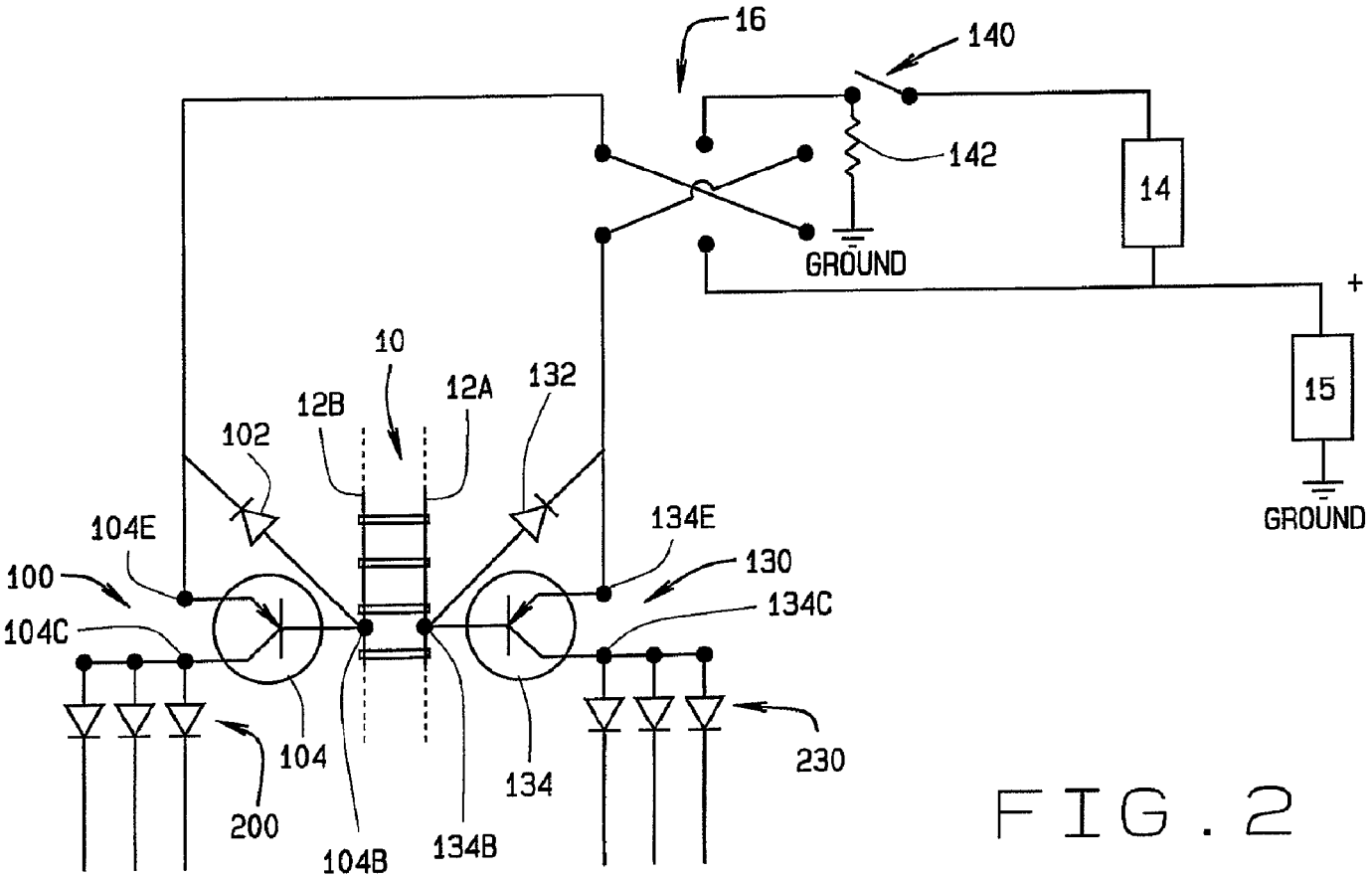
FIG. 2 is a schematic representation of a model train detection circuit of the present invention for detecting movement in two directions along a track segment.

FIG. 2 illustrates a second embodiment of the present invention, wherein a second train detector 130, consisting of a diode 132 and a transistor 134 is operatively coupled between the conductive rail 12A and the sources of electrical power 14 and 15. The diode 132 is coupled between the conductive rail 12A and the source of electrical power 14 to provide a third electrical pathway. A fourth electrical pathway between the conductive rail 12A and the source of electrical power 14 is provided by the transistor 134. Specifically, as shown in FIG. 2, a base 134B of the transistor 134 is operatively coupled to the conductive rail 12A, while an emitter 134E of the transistor is operatively coupled to the source of electrical power 14. A collector 134C of the transistor is operatively coupled to an external electrical circuit 230, such as an indicator, relay, or other device.

When a model train (not shown) is disposed on the track segment 10, and the conductive rails 12A and 12B are configured with the first polarity configuration, the diode 132 blocks the flow of electrical current over the third electrical pathway. Instead, the circuit is completed from the source of electrical power 14 to rail 12A over the fourth electrical pathway through the emitter 134E of the transistor 134. From the emitter 134E, the electrical current flows to the base 134B, through the conducive rail 12A, through the driving engine (not shown) of the model train (not shown), into rail 12B, and back to the source of electrical power through the diode 102, driving the model train (not shown) in the first direction. The flow of electrical current is blocked from the external electrical circuit 200 by the transistor 104, while within the transistor 134, an additional flow of electrical current is directed from the emitter 134E to the collector 134C, and provided to the external electrical circuit 230.

When the reversing switch or relay 16 is actuated, the polarity configuration of the conductive rails 12A and 12B is reversed as previously described. The diode 102 blocks a flow of electrical current along the first electrical pathway, and instead, electrical current flows from source of electrical power 14, to the emitter 104E of the transistor 104. From the emitter 104E, the electrical current flows to the base 104B, through the conducive rail 12B, driving engine (not shown) of the model train (not shown), conductive rail 12A, and back to the source of electrical power 14 over the third electrical pathway through diode 132. The fourth electrical pathway is blocked by the transistor 134. The model train (not shown) is then driven by the flow of electrical current in a second and opposite direction along the segment of track 10. As previously described, within the transistor 104, an additional flow of electrical current is directed from the emitter 104E to the collector 104C, and provided to the external electrical circuit 200.

In the embodiment of the present invention shown in FIG. 2, the train detectors 100 and 130 are configured to energize the respective external electrical circuits 200 and 230 only when the model train (not shown) is moving over the track segment 10 in the associated directions. If the external electrical circuits 200 or 230 include an indicator such as a light emitting diode 202, this indicator will selectively indicate the presence of a model train on the track segment 10 only when the track polarity (and hence train movement) is selected via the switch 16 such that the electrical current flow between the rails 12A and 12B passes through the transistors 104 or 134 coupled to the respective external electrical circuits 200, 230.

Additionally shown in FIG. 2 is a block switch 140 coupled between the source of electrical power 14 and the relay switch 16. The block switch 140 is configured to selectively disconnect the source of electrical power 14 from the track segment 10. To enable the detection circuits 100 and 130 to continue to function, a resistor 142 coupled to the switch 16 provides an alternate pathway to an electrical ground from the detector power supply 15, through the track segment 10 and each of the detector circuits 100, 130 when the block switch 140 is opened.

Figure 3:
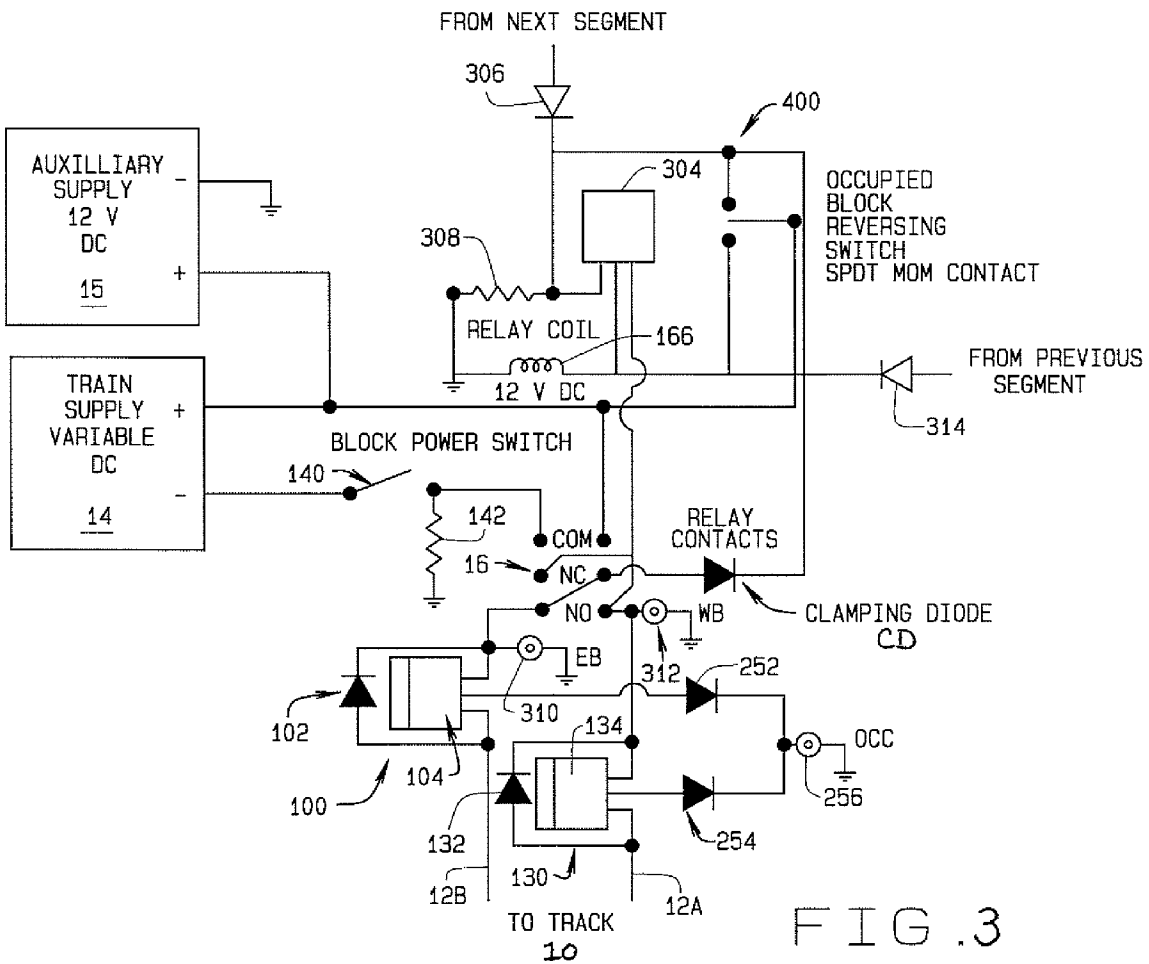
FIG. 3 is a schematic of a track segment polarity reversing relay circuit.

Turning to FIG. 3, an optional configuration of an external circuit 200, 230 as a polarity reversing relay 300 is shown for use with the detection circuits 100, 130, requiring only a single DPDT relay 166 and including a clamping diode CD to prevent transistor leakage current from accidentally energizing the relay. When a detection circuit 100 or 130 is activated by the presence of a model train (not shown) traveling in the associated direction on an adjacent track segment 10*n*, it is necessary to switch the polarity of the track segment 10 to match the polarity of track segment 10*n*, ensuring that the model train (not shown) continues to move in the same direction. Polarity reversing relay circuit 300 is operatively coupled to the polarity switch 16 of a track segment 10. The relay circuit 300 includes an electrically actuated relay element 166, a transistor 304, diodes 306 and 314, and a resistor 308. The emitter 304E of the transistor 304 is coupled to the sources of electrical power 14, 15 through the reversing switch or relay 16, which is shown having normally open (NO) and normally closed (NC) contacts. The electrically actuated relay element 166 is coupled between an external circuit associated with a next-adjacent track segment in a first direction, and through diode 314 to the collector 304C of the transistor 304. The base of the transistor 304 is operatively coupled through the diode 306 to receive an electrical signal from an external circuit associated with a next-adjacent track segment in a second direction.

During operation of the polarity reversing relay circuit 300, the electrically actuated relay element 166 is energized by a latching pulse received from the external circuit associated with the next-adjacent track segment in the first direction. The relay element 166 remains energized by a flow of current passing from the emitter of transistor 304 to the collector of transistor 304 from the source of electrical power 14, 15. The relay element 166 will remain energized until it is de-energized by an unlatching pulse received from the external circuit associated with the next-adjacent track segment in the second direction. The unlatching pulse is received at the base of the transistor 304, blocking the current flow between the emitter and the collector of the transistor 304.

When the electrically actuated relay element 166 is energized, the relay element 166 operates the reversing switch or relay 16 to polarize the track segment 10 with the same polarity as the next-adjacent track segment in the first direction. Conversely, when the electrically actuated relay element 166 is de-energized, the reversing switch or relay 16 is operated to polarize the track segment 10 with the opposite polarity, corresponding to the polarity of the next-adjacent track segment in the second direction. Optionally, an LED or other suitable indicators 310 and 312 may be operatively coupled to the reversing switch or relay 16, to provide an operator with an indication of the polarity (i.e. direction of train travel) of the track segment 10 at any given point in time.

Figure 4:
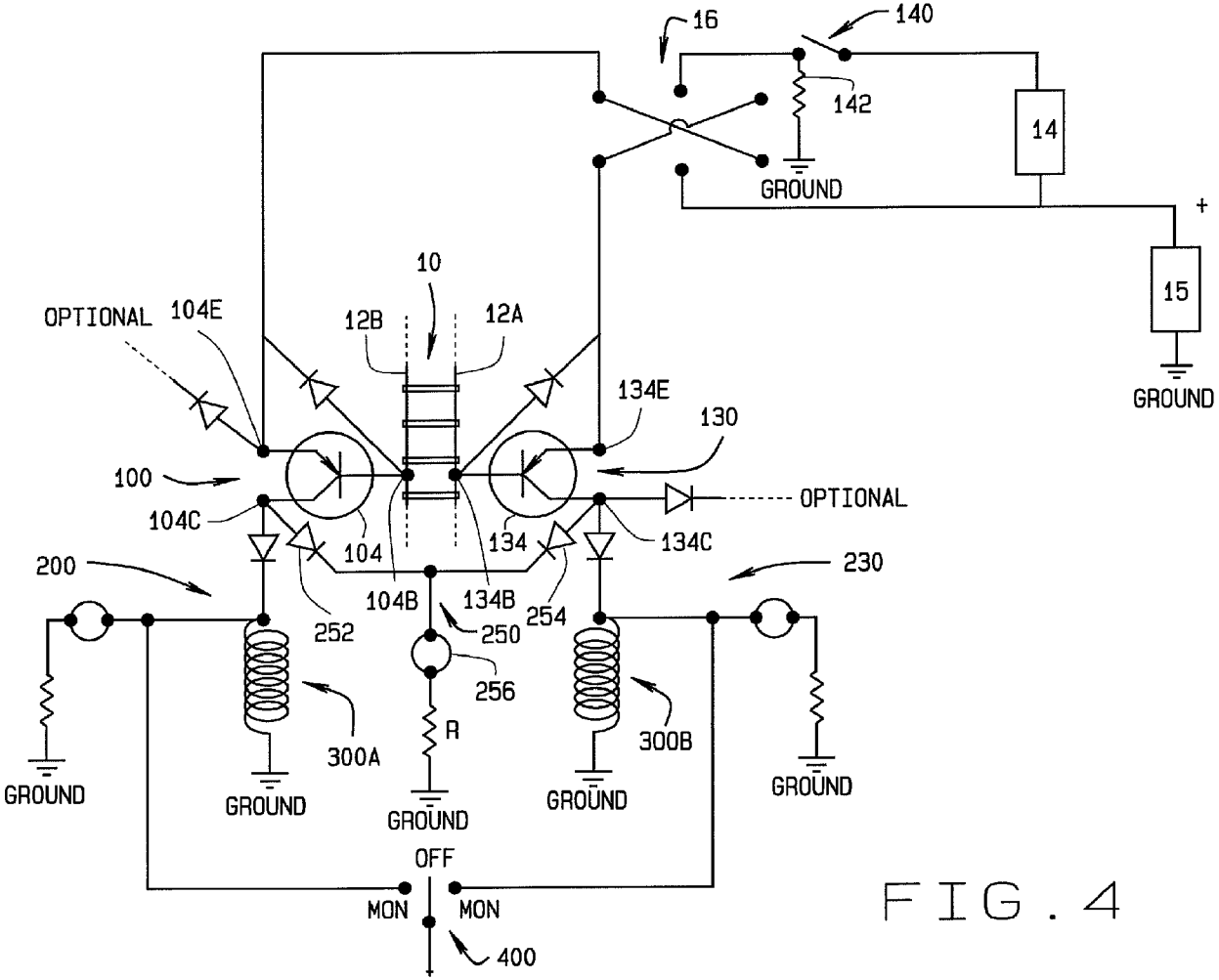
FIG. 4 is a schematic representation of a model train detection circuit utilizing diodes to isolate transistor outputs, which is coupled to an optional track segment polarity reversing relay.
Figure 5A:
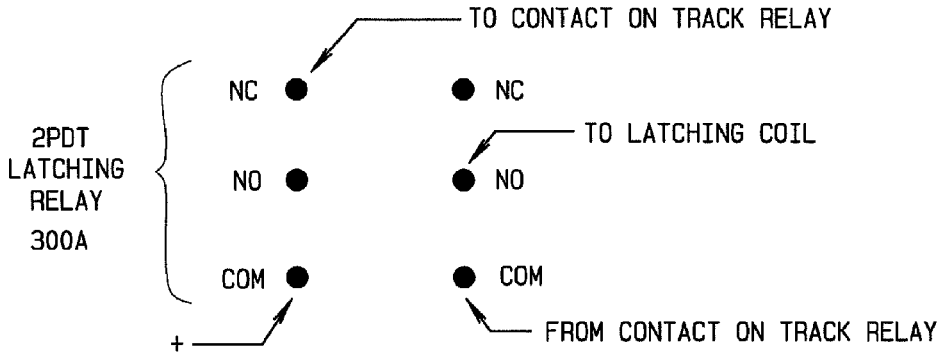
FIG. 5A is a representation of the connections to a two-pole double throw latching relay.
Figure 5B:
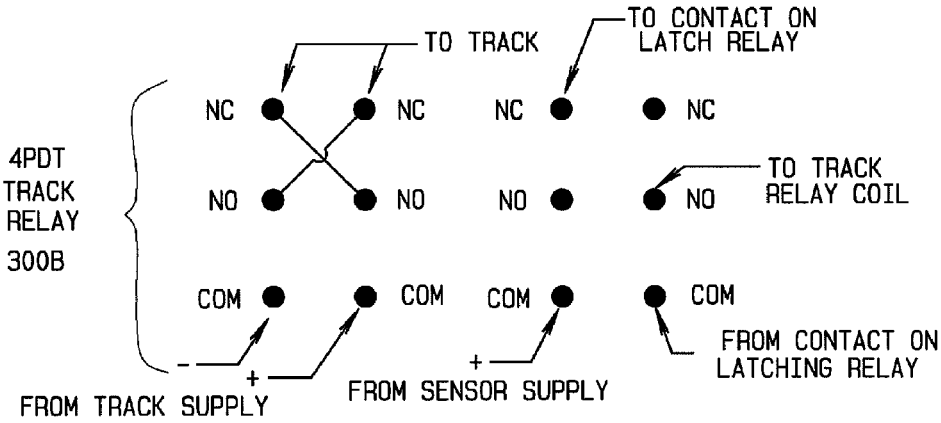
FIG. 5B is a representation of the connections to a four-pole double throw track relay.

The external circuits 200, 230 which are operatively coupled to the collectors of the detector circuits 100, 130 may include any of a variety of configurations as will be recognized by those of ordinary skill in the art. For example, as shown in FIG. 4, selection of a direction of train travel in a first direction on track segment 10 may be configured to provide positive electrical power to a two-pole double throw latch circuit 300A, shown in FIG. 5A, associated with a next track segment 10(+1) in a first direction, while selection of the opposite direction of train travel on track segment 10 provides the positive electrical power to the four-pole double throw track relay 300B, shown in FIG. 5B, associated with a next track segment 10(−1) in the second direction. Activation of either a latch relay 300A or a track relay 300B for a given track segment 10*n* will automatically deactivate the other relay 300A, 300B associated with that track segment.

Optionally, a common external circuit 250 may be operatively coupled between collectors 104C and 134C using isolating diodes 252 and 254. The common external circuit 250 will receive an electrical signal when a model train (not shown) is positioned on track segment 10 independent of the direction of travel of the model train (not shown), i.e. independent of the polarity of rails 12A and 12B. The common external circuit 250 may be provided with an indictor circuit to provide an operator with a visual indication of the presence of a model train (not shown) on the track segment 10. When used in conjunction with external circuits 200 and 230 which are activated in response to the model train presence or movement, the operator may be provided with information identifying the presence of a model train (not shown) on track segment 10 if moving or stationary, and, if moving, the direction of travel, i.e. track segment polarity. The circuits providing the identifying information to the operator may be located remotely from the track segments, such as on an operator control board, enabling an operator to track the model train through tunnels or behind features of a model train layout which obstruct direct visual observation of the train.

Optionally a track reversing switch 400, which is a spring-loaded momentary-on (MON) single pole, double-throw switch, may be coupled between external circuits 200 and 230 to allow for the operator to manually reverse the track direction for the track segment 10. The track reversing switch 400 will only reverse the train direction of travel for the associated track segment 10. Train travel direction on the remaining track segments 10*n* is regulated by the train travel direction on the occupied track segment 10, as previously described.

Those of ordinary skill in the art will recognize that track segments 10 configured with the train detector circuits 100, 130 and associated external circuits 200, 230 may be coupled together in a variety of different configurations in a model train track layout, such as shown in FIGS. 6-9.

Figure 6:
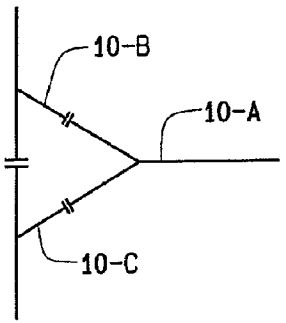
FIG. 6 is a representation of a "Y" junction model train track segment layout.

As shown in FIG. 6, track segments 10 may be coupled together to form a "Y" junction, wherein a model train (not shown) traveling on track segment 10-A towards track segments 10-B and 10-C will actuate external circuits associated with track segment 10-A to select matching track polarities on track segments 10-B and 10-C, enabling the movement of the model train (not shown) to continue regardless of the setting of the junction switch between the track segments. Correspondingly, a model train (not shown) traveling on either track segment 10-B or 10-C towards track segment 10-A will actuate external circuits to select a matching track polarity on track segment 10-A, enabling the movement of the model train (not shown) to continue in the same direction.

Figure 7:
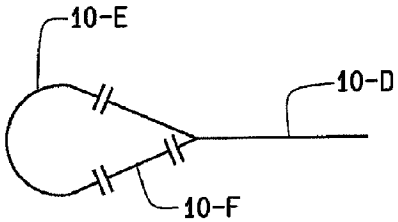
FIG. 7 is a representation of a reverse loop model train track segment layout.

As shown in FIG. 7, track segments 10 may be coupled together to form a reverse loop, wherein a model train (not shown) traveling on track segment 10-D towards track segments 10-E and 10-F will actuate external circuits associated with track segment 10-D to select matching track polarities on track segments 10-E and 10-F, enabling the movement of the model train (not shown) to continue around the loop regardless of the setting of the junction switch between the track segments. Correspondingly, a model train (not shown) traveling on either track segment 10-E or 10-F towards track segment 10-D will actuate external circuits to select a matching track polarity on track segment 10-D, enabling the movement of the model train (not shown) to continue in the same direction.

Figure 8:
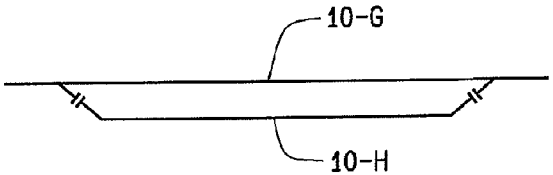
FIG. 8 is a representation of a siding model train track segment layout.

As shown in FIG. 8, track segments may be coupled together to form a siding, wherein a model train (not shown) traveling on track segment 10-G towards siding segment 10-H will actuate external circuits associated with track segment 10-G to select matching track polarities on track segment 10-H, enabling the movement of the model train (not shown) to continue onto the siding regardless of the setting of the junction switch between the track segments. Correspondingly, a model train (not shown) traveling on siding track segment 10-H towards track segment 10-G will actuate external circuits to select a matching track polarity on track segment 10-G, enabling the movement of the model train (not shown) to continue in the same direction off the siding track segment 10-H.

Figure 9:
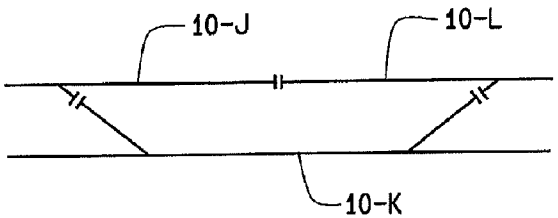
FIG. 9 is a representation of a cross-over model train track segment layout.

As shown in FIG. 9, track segments may be coupled together to form a cross-over between parallel track segments. A model train (not shown) traveling on track segment 10-J towards segments 10-K and 10-L will actuate external circuits associated with track segment 10-J to select matching track polarities on track segments 10-K and 10-L, enabling the movement of the model train (not shown) to continue regardless of the setting of the junction switch between the track segments. Correspondingly, a model train (not shown) traveling on siding track segment 10-K towards track segment 10-J or 10-L will actuate external circuits to select a matching track polarity on track segments 10-J and 10-L, enabling the movement of the model train (not shown) to continue in the same direction.

Figure 10:
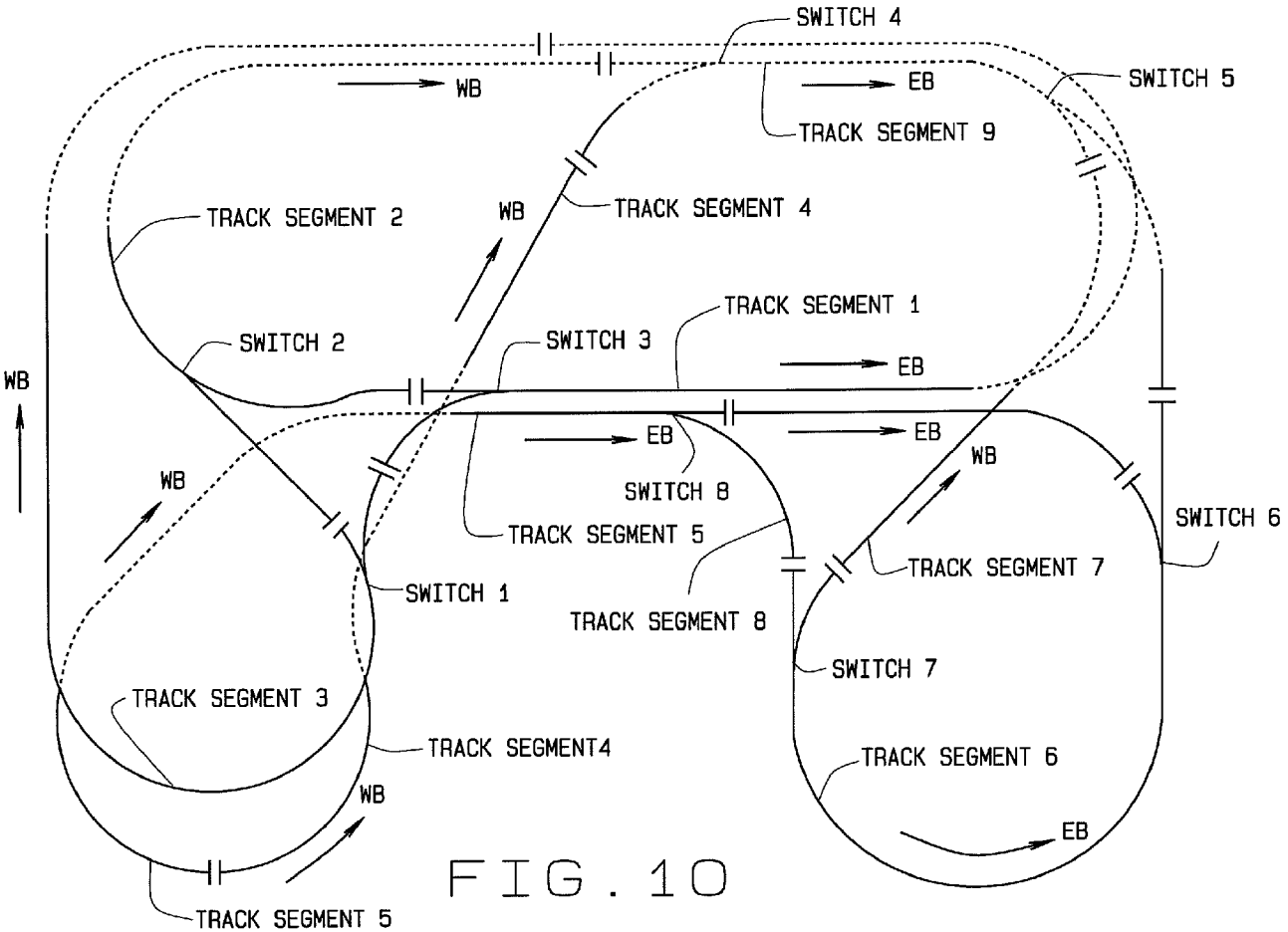
FIG. 10 is a representation of an N-scale model train track layout incorporating train detection circuits of the present invention.

By coupling multiple track segments 10 together in various configurations, and by operatively connecting external circuits 200 and 230 for each track segment 10 to polarity switches or relays 16 for adjacent track segments, complex model train track layouts, such as shown in FIG. 10, may be assembled. In the complex model train track layout show in FIG. 10, the direction of model train travel is defined by the illustrated arrows as either eastbound or westbound over a given track segment. External circuits 200 for track segments 10 which are energized by model train movement in an eastbound direction are operatively coupled to latch relay circuits 300A in the next eastern-direction track segment, while external circuits 230 for track segments 10 which are energized by model train movement in a westbound direction are operatively coupled to track relay circuits 300B in the next western-direction track.

Movement of a model train east-bound (EB) or west-bound (WB) over the track segments show in the layout of FIG. 10 results in track segment activations according to the following table:

| Track Segment | Direction of Travel | Sequentially Activated Segments |
|---|---|---|
| 1 | EB | 3-EB |
| 1 | WB | 2-WB & 3-WB |
| 2 | EB | 1-EB & 3-WB |
| 2 | WB | 9-EB |
| 3 | EB | 2-WB & 1-EB |
| 3 | WB | 1-WB |
| 4 | EB | 5-EB |
| 4 | WB | 9-EB |
| 5 | EB | 6-EB & 8-EB |
| 5 | WB | 4-WB |
| 6 | EB | 9-WB & 8-WB |
| 6 | WB | 7-WB & 5-WB |
| 7 | EB | 6-EB |
| 7 | WB | 9-WB |
| 8 | EB | 6-WB |
| 8 | WB | 5-WB |
| 9 | EB | 7-EB & 6-WB |
| 9 | WB | 2-EB & 4-EB |

When a latch relay 300A is energized for a given track segment, enabling eastbound travel, the track relay 300B is correspondingly de-energized for that track segment. Conversely, when a track relay 300B is energized for a given track segment, enabling westbound travel, the latch relay 300A is correspondingly de-energized for that track segment.

Those of ordinary skill in the art will recognize that the specific electrical circuit components illustrated in the figures and described in the specification may be replaced by other electrical components which are intended to accomplish the same functions described herein. For example, PNP transistors may be replaced by NPN transistors provided the associated electrical connections are appropriately modified. Similarly, relay coil components may be replaced by transistorized electronic circuits without altering the scope of the present invention.

As various changes could be made in the above constructions without departing from the scope of the invention, it is intended that all matter contained in the above description or shown in the accompanying drawings shall be interpreted as illustrative and not in a limiting sense.

The invention claimed is:

1. A model train detection circuit for use with a segment of track in a model railroad layout having two rails of opposite polarity across which a flow of electrical current drives a model train, comprising:

a polarity reversing relay circuit;

a polarity switch operatively coupled between a source of electrical power and said first and second rails of said track segment, said polarity switch including a double-pole, double throw switch configured to respond to said polarity reversing relay circuit; wherein said polarity reversing relay circuit is further configured to selectively energize said track segment with a polarity matching said adjacent track segment in response to a signal from a train detecting circuit configured to detect the presence of a model train by a directional flow of electrical current from an external power source, through the model train electrically coupling the two rails on the adjacent track segment and which is traveling towards said track segment; and wherein said polarity reversing relay circuit includes a clamping diode configured to prevent transistor leakage current from accidentally energizing said polarity reversing relay circuit.

2. A model train detection circuit for use with a segment of track in a model railroad layout having two rails of selectable opposite polarity between which a flow of electrical current drives a model train, comprising:

a polarity reversing relay circuit configured to receive polarity signals from next adjacent track segments in each direction of travel;

a polarity switch operatively coupled between a source of electrical power and said first rail of said track segment, said polarity switch including a single double pole, double throw relay configured to respond to said polarity reversing relay circuit;

a first train detector circuit including a first diode coupled between said first rail of the track segment and a source of electrical power, said first diode providing a pathway for a flow of driving electrical current responsive to said polarity switch selecting a first polarity and a model train electrically coupling said first rail to said second rail; and a second train detector circuit including a second diode coupled between said second rail of the track segment and a source of electrical power, said second diode providing a pathway for a flow of driving electrical current responsive to said polarity switch selecting a second polarity and a model train electrically coupling said first rail to said second rail.

3. The model train detection circuit of claim 2 further including:

a transistor coupled to said first rail of the track segment, to said source of electrical power, and to an external electrical circuit, said transistor providing a pathway for a flow of driving electrical current to a first external electrical circuit when said first rail has a first polarity and a model train is electrically coupling said first rail to said second rail; and a second transistor coupled to said first rail of the track segment, to said source of electrical power, and to a second external electrical circuit, said second transistor providing a pathway for a flow of driving electrical current to said second external electrical circuit when said first rail has a first polarity and a model train is electrically coupling said first rail to said second rail.

* * * * *